US005390939A

United States Patent [19]

Terauchi et al.

[11] Patent Number: 5,390,939

[45] Date of Patent: Feb. 21, 1995

[54] JOINT SEALING MEMBER

[75] Inventors: Michiyoshi Terauchi; Hiroshi Shinjo; Kazuhiro Takasaki; Takahide Kameda, all of Saitama, Japan

[73] Assignee: C. I. Kasei Co., Ltd., Tokyo, Japan

[21] Appl. No.: 629,173

[22] Filed: Dec. 19, 1990

Related U.S. Application Data

[63] Continuation of Ser. No. 406,173, Sep. 12, 1989, abandoned, which is a continuation of Ser. No. 681,772, Dec. 14, 1984, abandoned.

[30] Foreign Application Priority Data

Dec. 16, 1983 [JP] Japan ..... 58-192967[U]
Mar. 28, 1984 [JP] Japan ..... 59-43195[U]

[51] Int. Cl.[6] ..... F16T 15/24

[52] U.S. Cl. ..... 277/227; 277/180; 277/188 A

[58] Field of Search ..... 277/227, 180, 182, 183, 277/184, 188 R, 189; 285/925; 52/169.14, 403

[56] References Cited

U.S. PATENT DOCUMENTS

| | | | |
|---|---|---|---|
| 2,373,443 | 4/1945 | Arminston | 277/227 X |
| 2,646,677 | 7/1953 | Kubaush | 277/227 X |
| 2,849,070 | 8/1958 | Maly | 277/9.5 |
| 3,009,721 | 11/1961 | Newton | 277/188 X |
| 3,094,337 | 6/1963 | Pippert et al. | 277/227 X |
| 3,099,110 | 7/1963 | Spaight | 277/227 X |
| 3,153,541 | 10/1964 | Rudder | 277/180 |
| 3,166,332 | 1/1965 | Olson | 277/180 X |
| 3,355,181 | 11/1967 | Olson | 277/227 X |
| 3,490,776 | 1/1970 | Avery | 277/180 |
| 4,059,280 | 11/1977 | Eastwood | 277/188 A |
| 4,305,595 | 12/1981 | Miyasishima et al. | 277/188 A X |
| 4,558,875 | 12/1985 | Yamaji et al. | 52/169.14 X |

FOREIGN PATENT DOCUMENTS

| | | | |
|---|---|---|---|
| 565642 | 12/1932 | Germany | 277/180 |
| 1072891 | 6/1967 | United Kingdom | 277/227 |

*Primary Examiner*—William A. Cuchlinski, Jr.
*Assistant Examiner*—Daniel G. Depumpo
*Attorney, Agent, or Firm*—Sughrue, Mion, Zinn, Macpeak & Seas

[57] ABSTRACT

A joint sealing member such as may be used in civil engineering works for providing a watertight seal between joint members is disclosed. In one embodiment, the sealing member takes the form of a band-like member constituted by a central portion made of a water expansible material which expands upon absorbing water and lateral nonexpansible portions made of a rubber which does not change in volume when in contact with water. The thickness of the central portion is greater than that of the lateral portions. In another embodiment, the joint member takes the form of a belt-like base plate made of a water expansible material having one or more longitudinally extending rib-like ridge portions formed on one side thereof.

3 Claims, 9 Drawing Sheets

PRIOR ART

JOINT SEALING MEMBER

This is a continuation of application Ser. No. 07/406/173, filed Sep. 12, 1989, now abandoned, which is a continuation of application Ser. No. 06/681,772, filed Dec. 14, 1984, now abandoned.

BACKGROUND OF THE INVENTION

The present invention relates to joint sealing members used for effecting water stopping processing at junctions of members used for civil engineering works or the like.

For example, as shown in Fig s. 1, 2A and 3, plural unit segments 1 are used as work materials in constructing a shield tunnel excavated underground. These unit segments 1 are closely joined in the direction a along the peripheral wall and in the longitudinal direction b of the gallery.

At the four sides of a plate portion of each of the segments 1, there are provided front and rear flanges 2 and 3 extending in the circumferential direction a around the peripheral walls, and upper and lower flanges 4 and 5 extending in the longitudinal direction b. When these segments are joined, the adjacent flanges 2 and 3, and the adjacent flanges 4 and 5, are respectively joined and clamped by means of joint bolts 6.

In order to prevent water seeping out of the earth around the gallery from leaking into the gallery, it is necessary to effect water stopping processing at the respective junctions of the joined flanges. To this end, a band-like joint sealing member 8 is secured by bonding onto one side of the flange surfaces facing gaps 7 between adjacent flange surfaces.

For the illustrated conventional sealing member 8, for example, a well-known water expansible material such as a material obtained by mixing, synthesizing and vulcanizing high hygroscopic resin and synthetic rubber is used. The sealing member 8 is formed into a single layer using the above-mentioned material, The sealing member 8 expands due to infiltration of water W into the joint so as to watertightly seal the gap 7.

In the case where such a sealing material 8 shaped in a single layer is used, however, since the water expansible material has a property of expansion in three dimensions, there occurs considerable expansion A in the lateral direction in addition to the desired expansion in the direction of the thickness of the joint after absorption of the infiltrated water W, in spite of suppression of such expansion in the lateral direction by the fixing action at the junction. Accordingly, there are problems that not only is there apt to be splitting at a portion A of the expansion, but also over time the sealing member 8 may be detached due to a reduction in bonding force due to the effects of expansion stress.

In order to completely perform so-called initial water stopping processing before the sealing member expands due to water absorption by using such a conventional sealing member 8, it is necessary to make the sealing member 8 thicker, in which case not only is the material cost high, but also there occurs frequently a problem of the sealing member 8 more easily becoming dislodged from the junction of the segment 1 in transport or the like.

FIG. 2B depicts another prior art arrangement. In the middle portion in the direction of width of each of the outer surfaces of the flanges 2 and 4 of each of the segments a belt-like fitting groove (for example, a groove 4*a* in the flange 4) is formed, and a joint member 8 is fixed in each of the fitting grooves. The surface of the joint member 8 projects from the outer surface of each of the flanges 2 and 4.

The flanges 2 and 3 of the respective segments 1A and 1C are fixedly clamped together by three connecting bolts 6, and the flanges 4 and 5 of the respective segments 1A and 1B are fixedly clamped by two connecting bolts 6 such that the joint member 8 is compressed by the a thickness t and the outer surface of the joint member 8 is urged against the outer surface of the flange 5 by elastic force, thereby effecting water stopping processing at the joint junction.

In this arrangement, the joint member 8 must be made thicker so as to sufficiently include the thickness t therein so that the joint member 8 largely projects from the flange 4. Accordingly, not only is a large amount of effort required for screwing on the nuts 6*a*, but also the projecting edge of the joint member 8 is apt to be caught thereby, causing the joint member 8 to slip out of the fitting groove 4*a*.

To overcome these difficulties, there have been proposed various arrangements, such as the arrangement shown in FIG. 5A in which as a core of a sealing member 9 a nonexpansible rubber material 10 is filled therein, an arrangement as shown in FIG. 6A in which the shape of a sealing member 11 is maintained by a nonexpansible resin member 12 having an H-shaped cross-section, an arrangement as shown in FIG. 7A in which a nonexpansible rubber member 14 is disposed under a sealing member 13 and joined therewith, etc. There are unsolved problems in the above-mentioned proposals, as follows:

(a) The sealing members 9 and 11 (see FIG. 53 and FIG. 6B, respectively):

Since the bottom surface of the water expansible material portion lower than each of the nonexpansible rubber materials 10 and 12 is bonded to a groove surface, sufficient expanding force cannot be obtained in the direction of thickness of the joint because of interference of the rubber materials 10 and 12.

(b) The sealing member 13 (see FIG. 7B):

It is impossible to completely suppress sideward expansion, although it is possible to prevent the deterioration in bonding force of the bottom surface of the sealing member 13 which occurs over time.

SUMMARY OF THE INVENTION

The present invention has been attained to solve the difficulties mentioned above.

A specific object of the present invention is to provide a joint sealing member mainly constituted by a water expansible material in which effective expansion in the direction of thickness can be obtained so that sideward hanging/expansion can be suppressed, stable bonding of the bottom surface of the sealing member can be obtained, and effective initial water stopping processing can be accomplished without increasing the thickness of the sealing member.

Accomplishing the above object, a band-like joint sealing member according to the present invention is featured in that the band-like joint sealing member is constituted by joining an expansible portion made of a water expansible material having a property of expansion of its volume upon absorbing water, and nonexpansible portions made of nonexpansible rubber having a property of maintaining a constant volume even if in contact with water, the expansible and nonexpansible portions being joined in the direction of width in the state where the expansible portion is sandwiched by the nonexpansible portions, the thickness from a bottom to a top surface at at least one portion on the width line of the expansible portion being made thicker than the thickness from the band-like bottom to the top surface at the nonexpansible portions.

Further in accordance with the invention, the joint members can be formed with longitudinally extending rib-like ridge portions formed integrally on one surface of a band-like base plate made of a water expansible material.

DESCRIPTION OF THE PREFERRED EMBODIMENTS

Figure 1:
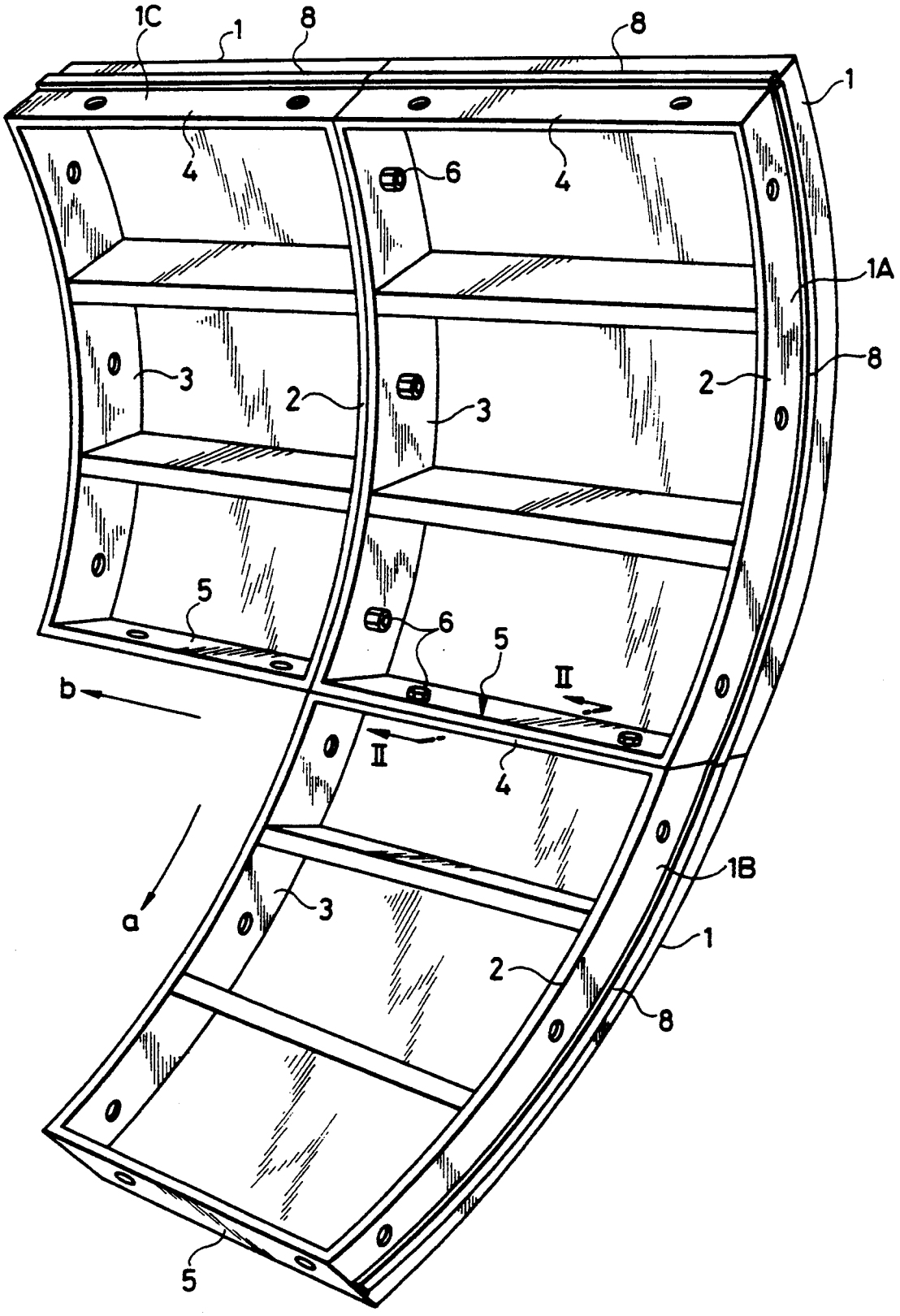
FIG. 1 PRIOR ART
FIG. 1 is a perspective diagram of a portion of a sealed construction.
Figure 2A:
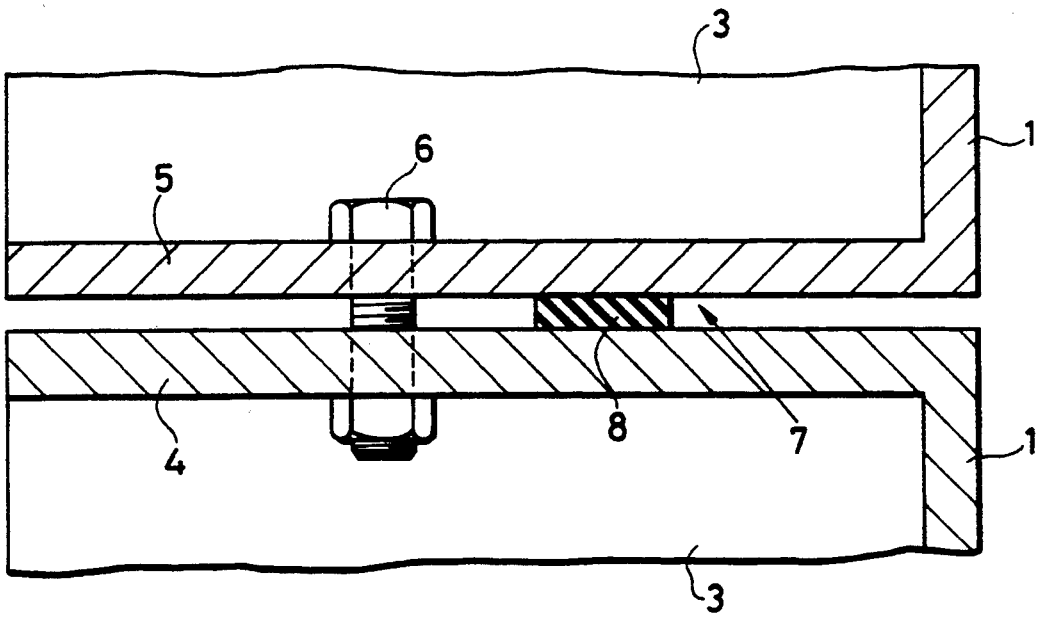
FIG. 2A PRIOR ART
FIGS. 2A and 2B are cross-sectional views taken along a line II—II in FIG. 1.
Figure 2B:
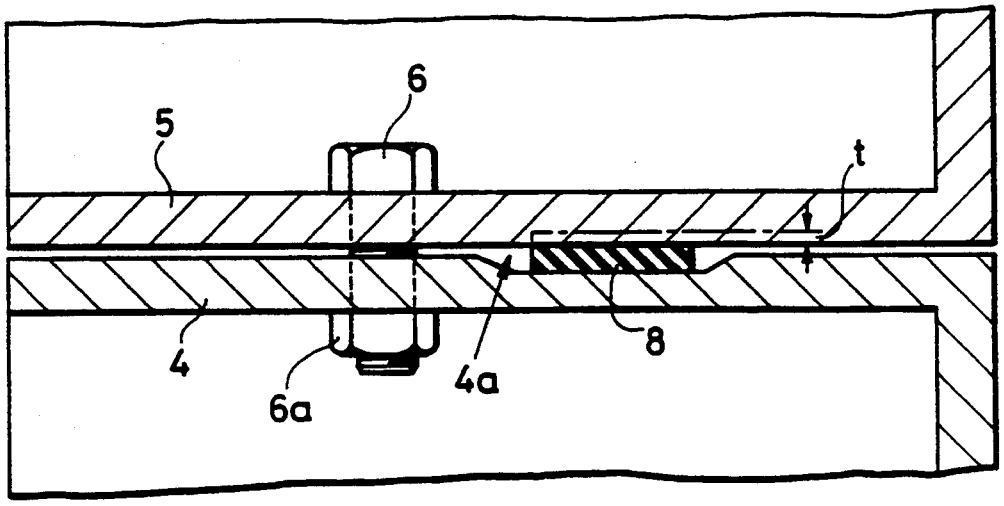
FIG. 2B PRIOR ART
Figure 3:
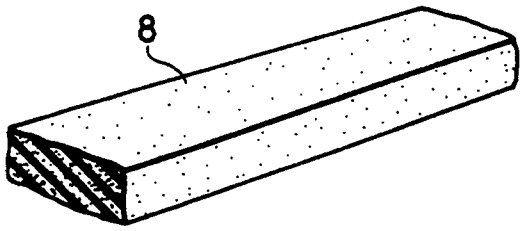
FIG. 3 PRIOR ART
FIG. 3 is a perspective view, partially cut away, of a sealing member employed in the arrangement of FIG. 2A.
Figure 4:
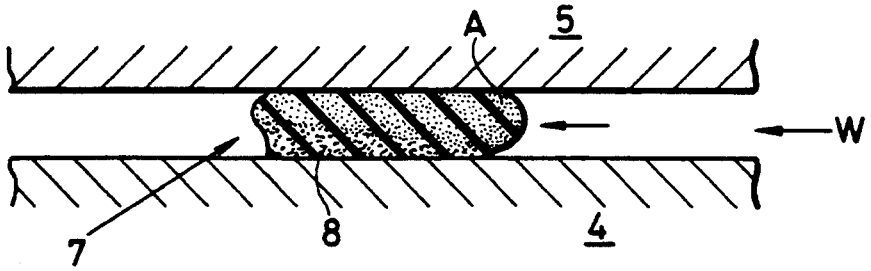
FIG. 4 PRIOR ART
FIG. 4 is a cross-sectional view illustrating a drawback with the sealing member of FIG. 3.

Referring to the drawings, the present invention will be described hereunder.

Figure 8:
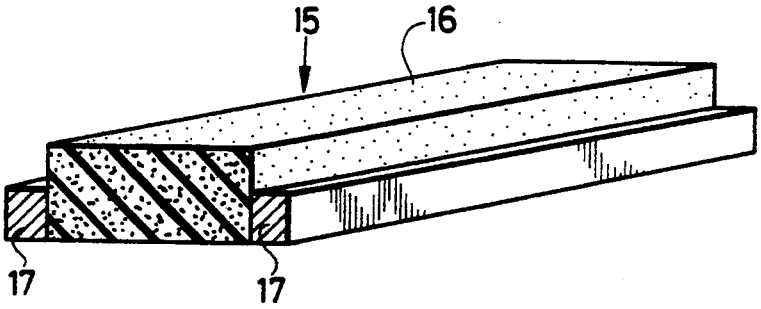
FIG. 8. is a perspective view, partially in cross section, of a joint sealing member in accordance with a first embodiment of the invention.
Figure 9A:
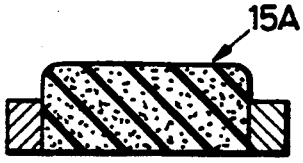
FIGS. 9A through 9E and FIGS. 10A and 10B are cross-sectional views showing modifications of the sealing member of the invention.
Figure 9B:
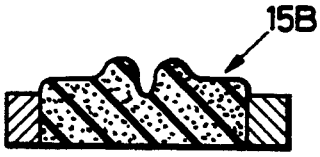
Figure 9C:
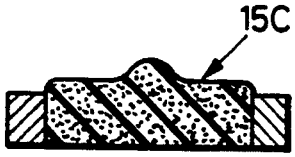
Figure 9D:
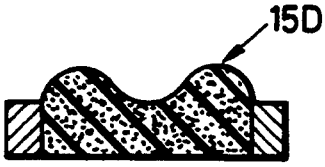
Figure 9E:
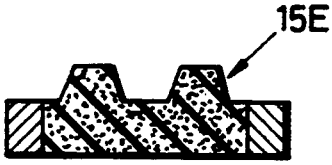

A sealing member 15 of a preferred embodiment, as shown in FIG. 8, is a longitudinally extending band-like member of a flexible material. Although this sealing member 15 is here shown as having a rectangular shape in cross section, in the case where the shape of the joint junction to which the sealing joint is to be secured is ring-like, the joint member is shaped ring-like to conform with the shape of the joint junction.

As to the terms used in the following description, with respect to directions, the terms "upper and lower" and "thickness" are used with respect to the vertical direction in the drawings, and the terms "left and right", "width" and "transverse" are used in conjunction with the horizontal direction in the drawings.

The sealing member 15 is constituted by three layers transversely joined with each other, one layer being an expansible thick portion 16 made of a water expansible rubber material, disposed at the center in the width direction, and having a transversely elongated rectangular cross-section, and the other layers being a pair of non-expansible portions 17 each made of a nonexpansible rubber material, disposed at the left and right sides of the expansible portion 16 and each having a rectangular cross-section and a bottom sur face made .even with that of the expansible portion 16. The thickness of each of the right and left nonexpansible portions 17 is made about two-thirds as thick as that of the expansible portion 16. Thus, the sealing member 15 is shaped such that the expansible portion 16 is projected upward at the center between the left and right nonexpansible portions 17.

The expansible portion 16 is made of the above-mentioned well-known water expansible material, while each of the nonexpansible portions 17 is made of an ordinary rubber material, the volume of which does not change even if in contact with water.

Figure 5A:
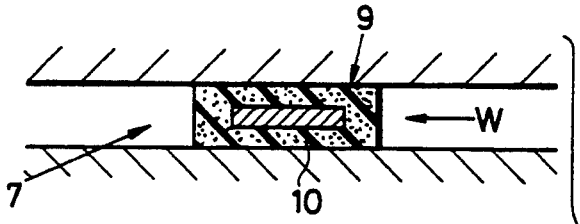
FIGS. 5A through 7B are sectional diagrams showing different kinds of conventional sealing members (FIG. 5A, 6A and 7A) and the advantages thereof (FIG. 5B, FIG. 6B and 7B)
Figure 5B:
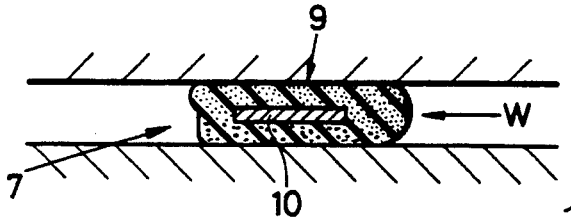
Figure 6A:
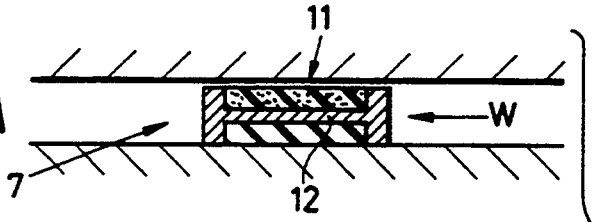
PRIOR ART FIG. 6A
Figure 6B:
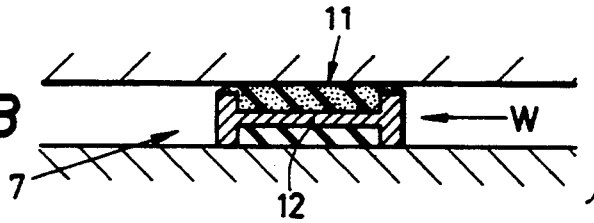
Figure 7A:
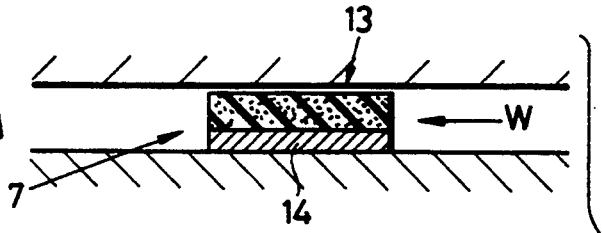
PRIOR ART FIG. 7A
Figure 7B:
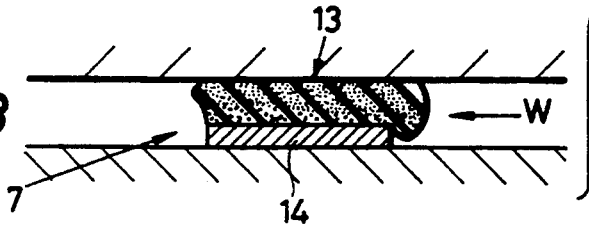

When the sealing member 15 is secured to a joint junction, as illustrated in the examples of FIGS. 5 to 7, the bottom surface of the sealing member 15 is bonded and secured in the gap 7 between the adjacent flange surfaces or in an attachment groove formed in one of the flange surfaces by means of a bonding agent or the like.

At the joint junction formed the thus arranged sealing member 15, the projecting portion of the middle expansible portion 16 in the sealing material 15 closes a space between joints for initial water stopping at the beginning of joining. It is not necessary to make the entire sealing material 15 thicker. Thus, there occurs no dislodging of the sealing member after time and the material cost is reduced.

When the sealing member 15 is permeated with infiltrated water W, the expansible portion 16 absorbs water and expands so that the upper face of the sealing member 15 is pressed against the bonding surface so as to completely watertightly seal the joint.

During this operation, since the longitudinally expanding force of the expansible portion 16 is suppressed by the stopping function of both sides of the nonexpansible portion 17, the sealing member expands effectively only in the direction of thickness to increase the elastic force of the upper surface thereof. Further, although the upper half of the expansible portion 16 expands somewhat transversely, the thickness of the nonexpansible portion 17 is small, and therefore the transversely expanded portion does not protrude sidewards from the upper surface of the nonexpansible portion 17 so that there is no risk of splitting of the expansible portion.

Since movement of the bottom surface of the sealing member 15 is suppressed by the nonexpansible portions 17 from the opposite sides thereof, no shearing stress acts on the bottom surface so that the bonding agent is not pulled off.

Thus, even after the sealing member has absorbed water, there is little risk of deterioration in the water stopping function due to problems with the sealing member 15.

Figure 10A:
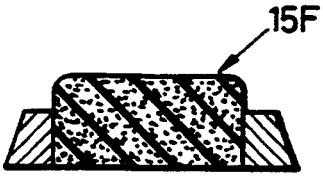
Figure 10B:
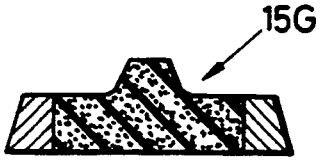
Figure 11A:
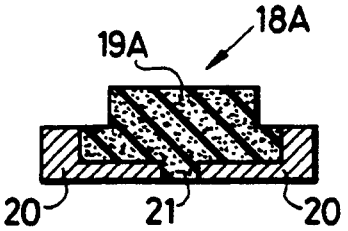
FIGS. 11A through 11E are cross-sectional views showing different examples of sealing members according to a second embodiment of the invention.
Figure 11B:
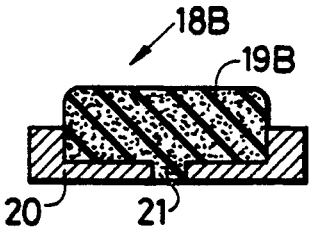
Figure 11C:
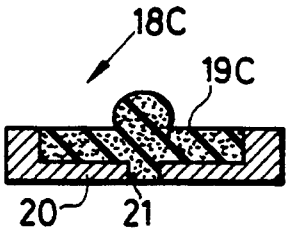
Figure 11D:
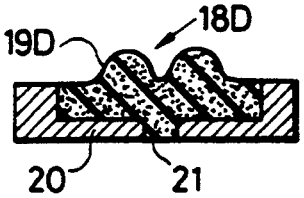
Figure 11E:
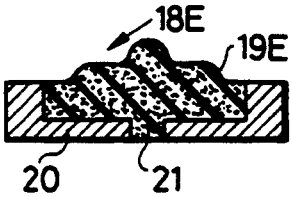

Although the upper surface of the expansible portion 16 is made flat in the above-mentioned embodiment, the same effect can be obtained, alternatively, by forming a ridge portion having a curved cross-section in the widthwise direction, such as the sealing members 15A to 15E shown in FIGS. 9A to 9E. Especially the sealing members of the types shown in FIGS. 9B to 9E provide better initial water stopping processing with the overall thickness of the material of the expansible portion 16 reduced. Further, although the opposite side walls of the nonexpansible portion 17 are made vertical with respect to the bottom in the above-described embodiment, the same effect can be obtained in a alternative case where the side walls have trapezoidal tapered surfaces, such as the cross-section of the two kinds of sealing members 15F and 15G as shown in FIGS. 10A and 10B.

Next, a second embodiment will be described.

In each of five kinds of sealing members 18A to 18E shown in FIGS. 11A to 11E, three layers are joined with each other, the middle one being an expansible portion 19A (19B–19E) and the other two disposed at the opposite sides of the expansible portion 19A being thin nonexpansible portions 20 each having an L-shaped cross section, the bottom of which extends toward the center in the widthwise direction. Further, a ridge portion 21 formed at the center of the lower surface of the expansible portion 19A (19B–19E) is exposed at the center in the widthwise direction of the bottom surface of the sealing member 18A (18B–18E).

In each of the thus arranged sealing members 18A–18E of this embodiment, in addition to the effects of the above-mentioned first embodiment, there are further advantages that since the ratio of the nonexpansible portion 20 occupying the bottom bonding surface of each of the sealing members 18A–18E becomes large, the bonding force is made more stable and the sealing ability of the bonding surface is made surer.

Figure 12:
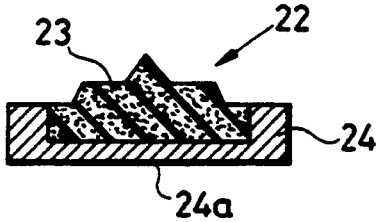
FIG. 12 is a cross-sectional view showing a sealing member according to a third embodiment of the invention.

A sealing member 22 according to a third embodiment, as shown in FIG. 12, is constituted by two (upper and lower) layers, one being an expansible portion 23 positioned in the center and the other being a nonexpansible portion 24 constituted by opposite side frames integrally formed through a transversely extending bottom plate portion **24*a* (the member 22** being constituted by three layers in the transverse direction).

In the thus-arranged seagoing member 22 according to the third embodiment, in addition to the effects of the first embodiment, there is an advantage that the bonding force of the sealing member 22 is increased.

In the arrangement of the sealing members 15, 15A–15G, 18A–18E and 22 of the respective embodiments, the amount of expensive water expansible material is reduced so that the production costs of the sealing member can be reduced.

Figure 18:
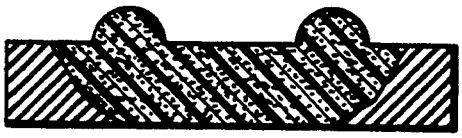
Figure 19:
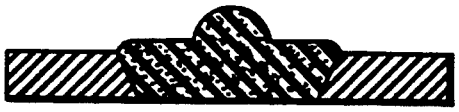
Figure 20:
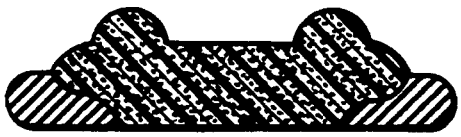

Other configurations for the sealing member are shown in FIGS. 18–20.

Further, the sealing members of the respective embodiments can be widely used for sealing junctions of secondary concrete products such as manholes, culvert boxes, or the like, in addition to the shield segments as described above.

As described above, the joint sealing member according to the present invention is constituted by joined layers including a thick water expansible rubber portion positioned in the central portion in the widthwise direction of a band-like sealing member, and a pair of thin non-expansible rubber portions positioned on the opposite sides of the thick expansible rubber portion. Accordingly, the overall thickness can be reduced, the material costs reduced, and the sealing member can be prevented from becoming dislodged to thereby perform the water stopping processing effectively. There are further advantages that the water expansible rubber portion is effectively expanded in the direction of thickness and unwanted sideward expansion is suppressed so that attachment of the sealing member to the bonding surface is stabilized to thereby improve its ability of stopping water and improve the durability of the sealing member.

Further embodiments of the invention will now be described.

Figure 13:
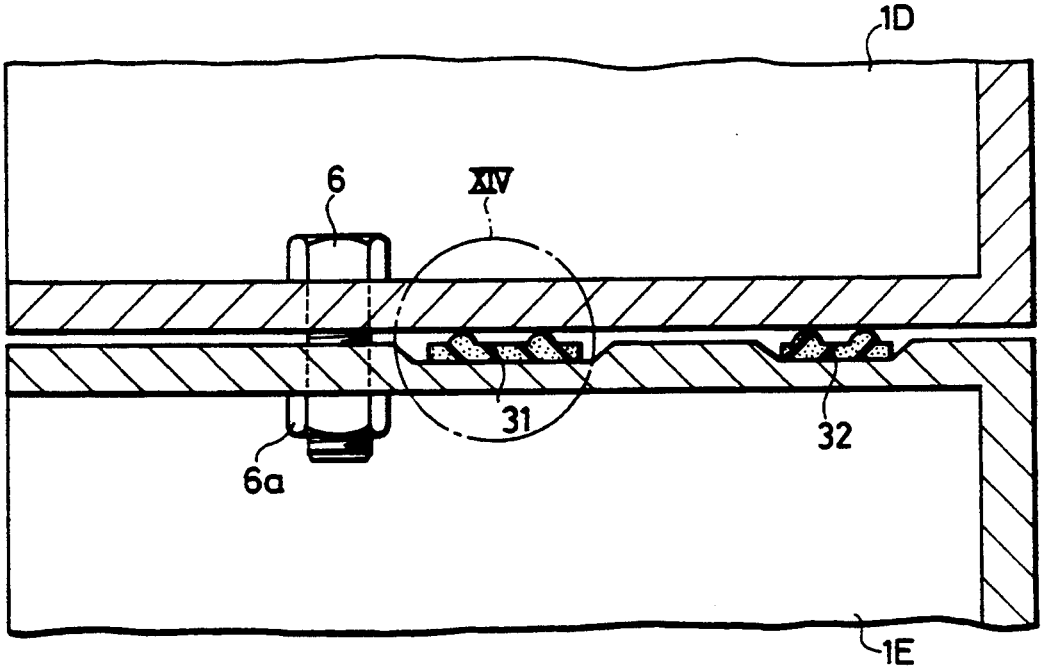
FIG. 13 is a cross-sectional view, similar to FIG. 2B, but illustrating sealing members according to further embodiments of the invention.

FIG. 13 shows a section of a joint junction portion where a wide joint member 31 (one embodiment),and a similarly-shaped narrow joint member 32 (another embodiment) are fixed in two rows between a flange 29 of a segment 1D and a flange 30 of a segment 1E. The joint members 31 and 32 are respectively adhered to fitting grooves **30*a* and 30*b* of the flange 30**.

Figure 14:
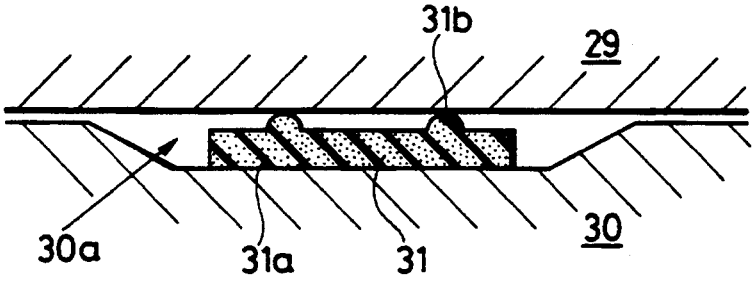
FIG. 14 is an enlarged cross-sectional view of a portion of FIG. 13.
Figure 15:
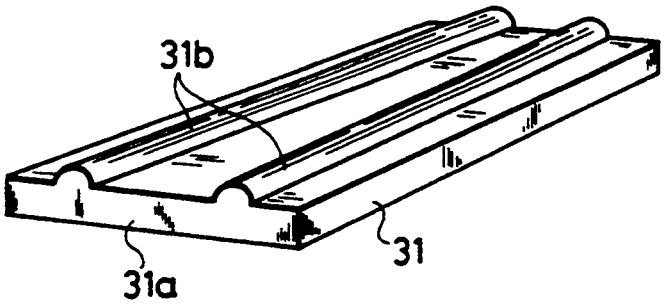
FIG. 15 is a perspective view of a sealing member used in the embodiment of FIGS. 13 and 14.
Figure 16:
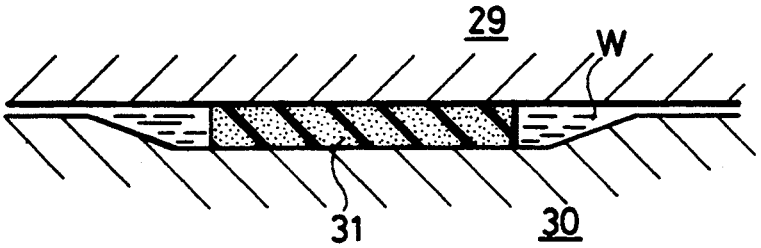
FIG. 16 shows the sealing member of FIG. 15 after it has been swollen by inpregnation with water.

Referring to FIGS. 14 to 16, the joint member 31 will be described in detail (the same applies to the joint member 32).

The joint member 31 is made of a material obtained by mixing, synthesizing and vulcanizing a water expansible material such as high-grade water resin and synthetic rubber. As the synthetic rubber, 1,3 diene group rubber containing a crystal domain (or glassy domain) of 5 to 10% at a normal temperature is used.

The joint member 31 has two rows of rib-like ridge portions **31*b* each having a substantially semicircular cross section extending upwardly from one surface of a strip-like elongated base plate portion 31*a***.

The thickness of the base plate **31*a* of the joint member 31 is substantially the same as the depth of the fitting groove 30*a* so that the surface of the base plate 31*a* is substantially even with the surface of the flange 30. Each of the ridge portions 31*b* is shaped to have a crest which is high enough to sufficiently project to fill the width t so that, in the state in which the nut 6*a* is screwed onto the connecting bolt 6 as shown in FIGS. 13 and 14, the crest portion of each ridge portion 31*b* is compressed by the thickness t and caused to closely contact with the surface of the flange 29** by its own elastic force.

With the joint member 31 according to this embodiment (the same applies to the joint member 32) arranged in the manner as described above, not only is there an advantage of saving material because of the smaller thickness of the base plate **31*a*, but also, since the base plate 31*a* becomes substantially even with the face of the flange 30, there is no risk that the joint member will be pulled out of the fitting groove 30*a* in the joint connecting operation. Moreover, since the crest portion of the ridge portion 31*b* is compressed when the fixing nut 6*a*** is screwed on, the tightening operation can be easily performed.

The joint member 31 of this embodiment provides sufficient watertightness due to close contact by the ridge portions **31*b* even at the initial stage, and after absorbing water, as shown in FIG. 16, the entire joint member 31 conforms to the flange 29** due to the force of expansion so that watertightness is always maintained.

Although it is preferable to use the joint member according to this embodiment of the present invention received in a fitting groove, the advantageous effects of the invention can be attained even in the case where the joint member is attached to a junction having no fitting groove.

Figure 17A:
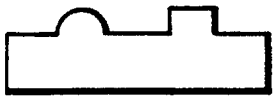
FIG. 17 (A)-(P) show configurations of other embodiments of sealing members of the invention.
Figure 17B:
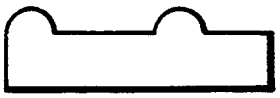
Figure 17C:
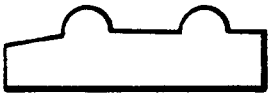
Figure 17D:
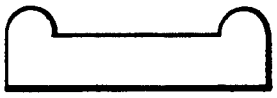
Figure 17E:
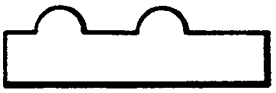
Figure 17F:
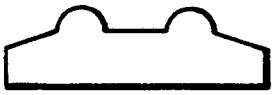
Figure 17G:
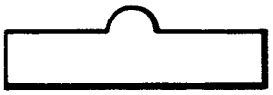
Figure 17H:
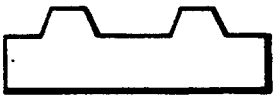
Figure 17I:
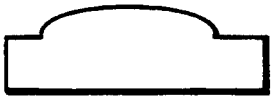
Figure 17J:
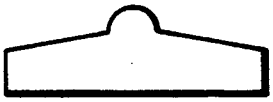
Figure 17K:
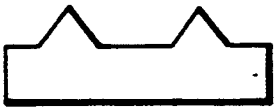
Figure 17L:
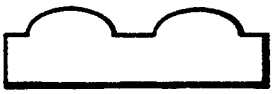
Figure 17M:
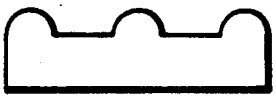
Figure 17N:
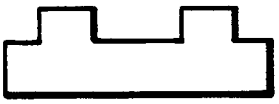
Figure 17O:
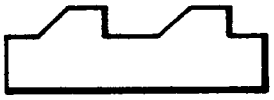
Figure 17P:
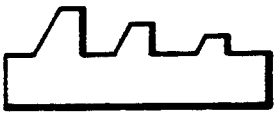

In addition to the case of water stopping processing at the joint junction of tunnel segments, the joint member according to the present invention can be widely used with the same effects in water stopping processing in joints of secondary concrete products such as culvert boxes, manholes, or the like, in joints of secondary steel products, colgate pipes, or the like. In this case, the shape of the cross section of the joint member is properly established in accordance with the conditions at hand. Possible shapes for the joint member are shown in FIGS. 17(A)–(P)–20, chosen taking the following design factors into consideration.

(a) Base Plate:

As the shape of the base plate, a rectangle, trapezoid, oblique trapezoid, or the like, is preferable. As the thickness is increased, the watertightness is improved, while the workability for installation is lowered so as to cause, for example, a reduction in the strength of reinforcement. On the contrary, if the base plate is made too thin, the opposite result is caused.

(b) Number of ridge portions:

Two rows are preferable. In the case of one row, the member is superior in compressibility and retention, but inferior in watertightness. The opposite result is caused in the case of three ridge portions.

(c) Shape of ridge portions:

A shape such as an arch, triangle, rectangle, oblique trapezoid, or the like, may be employed. It need not be isogonal or symmetrical. It is proper to select the height of the ridge portion in a range of 5% to 300% (20–150% is more preferable) of the thickness of the base plate of the joint member. Although the width of the ridge portion is not specifically limited, it is preferable to select it to be 10–40% of the width of the base plate of the joint member. It is preferable to select the sectional area of the ridge portion to be 1–200% of the sectional area of the base plate (5–500% is more preferable). If the ridge portion is too small, it is inferior in compressibility as well as in retention, and if it is too large, on the contrary, the watertightness is lowered.

As described above, a joint member for civil engineering works according to the present invention is formed such that longitudinally extending rib-like ridge portions are formed integrally on one surface of a belt-like base plate made of a water expansible material so that it is possible not only to reduce the cost of the joint member due to the reduction in thickness of the joint member, but also to improve its ease of installation.

I claim:

1. A band-like joint-sealing member for providing a water-tight seal between opposing frame members in a civil engineering construction, comprising: a central longitudinally extending portion made of water-expansible rubber having opposing surfaces, each of said opposing surfaces of the central portion facing a respective one of said opposing frame members, and lateral portions made of non-expansible rubber, one side of each of said lateral portions being bounded by and bonded to one of said opposing frame members, each of said lateral portions extending at least along a longitudinal length of said central portion so as to bound said central portion on two sides, said central portion further being bounded on one of said opposing surfaces by said one of said opposing frame members to which said lateral portions are bonded, the thickness of said central portion along at least one longitudinal line being thicker than said lateral portions, wherein said water-tight seal is achieved through contact of said central portion with water, the foregoing arrangement being such that said sealing member retains its position through bonding of said lateral portions with said one of said opposing frame members.

2. The band-like joint sealing member of claim 1, wherein said central portion has a plurality of longitudinally extending ridges having a thickness greater than the thickness of said lateral portions.

3. The band-like joint sealing member of claim 1, wherein said lateral portions are confined to sides of said central portion.

* * * * *